US006176741B1

(12) United States Patent
Shutter

(10) Patent No.: US 6,176,741 B1
(45) Date of Patent: Jan. 23, 2001

(54) MODULAR MICROELECTRONIC CONNECTOR AND METHOD FOR MANUFACTURING SAME

(75) Inventor: Ronald A. Shutter, Encinitas, CA (US)

(73) Assignee: Pulse Engineering, Inc., San Diego, CA (US)

( * ) Notice: Under 35 U.S.C. 154(b), the term of this patent shall be extended for 0 days.

(21) Appl. No.: 09/295,286

(22) Filed: Apr. 20, 1999

Related U.S. Application Data

(60) Provisional application No. 60/082,467, filed on Apr. 20, 1998.

(51) Int. Cl.[7] ..... H01R 13/66; H01R 33/945; H01R 43/04

(52) U.S. Cl. ..... 439/620; 439/676; 439/825; 29/877; 29/882

(58) Field of Search ..... 439/620, 676, 439/825; 29/874–885

(56) References Cited

U.S. PATENT DOCUMENTS

| | | | |
|---|---|---|---|
| 4,695,115 | 9/1987 | Talend . | |
| 4,726,638 | 2/1988 | Farrar et al. . | |
| 4,772,224 | 9/1988 | Talend . | |
| 4,995,834 | 2/1991 | Hasegawa . | |
| 5,011,438 * | 4/1991 | Awbrey | 439/825 |
| 5,015,204 | 5/1991 | Sakamoto et al. . | |
| 5,015,981 | 5/1991 | Lint et al. . | |
| 5,069,641 | 12/1991 | Sakamoto et al. . | |
| 5,139,442 | 8/1992 | Sakamoto et al. . | |
| 5,178,563 | 1/1993 | Reed . | |
| 5,282,759 | 2/1994 | Sakamoto et al. . | |
| 5,397,250 | 3/1995 | Briones . | |
| 5,399,107 | 3/1995 | Gentry et al. . | |
| 5,403,207 | 4/1995 | Briones . | |
| 5,456,619 | 10/1995 | Belopolsky et al. . | |
| 5,475,921 | 12/1995 | Johnston . | |
| 5,587,884 | 12/1996 | Raman . | |
| 5,647,767 | 7/1997 | Scheer et al. . | |
| 5,687,233 | 11/1997 | Loudermilk et al. . | |
| 5,736,910 | 4/1998 | Townsend et al. . | |
| 5,766,043 | 6/1998 | Talend . | |
| 5,872,492 | 2/1999 | Boutros . | |
| 5,876,239 | 3/1999 | Morin et al. . | |
| 5,928,005 * | 7/1999 | Li et al. | 439/825 X |

FOREIGN PATENT DOCUMENTS

| | | |
|---|---|---|
| 654865 | 5/1995 | (EP) . |
| WO94/05059 | 3/1994 | (WO) . |

* cited by examiner

*Primary Examiner*—Stanley J. Witkowski
(74) *Attorney, Agent, or Firm*—Knobbe, Martens, Olson & Bear LLP

(57) ABSTRACT

A simplified modular microelectronic connector having an internal component cavity and integral crimped leads, and a method of manufacturing same. One or more electrical components are located within the cavity, with their conductors being routed to the crimp leads integral to the connector body. The conductor terminations are completed via crimping or other bonding techniques. The crimped leads are deformed into the desired position to minimize connector size, and the component is sealed within the cavity using an epoxy or other electrically non-conductive material. The connector body may be further mounted to a multi-connector carrier assembly, which utilizes one or more pins to secure the individual connectors to the carrier so that they may be arranged in both vertically-stacked and horizontal ("side-by-side") configurations, and each connector may be removed separately and replaced in the event of component failure.

32 Claims, 9 Drawing Sheets

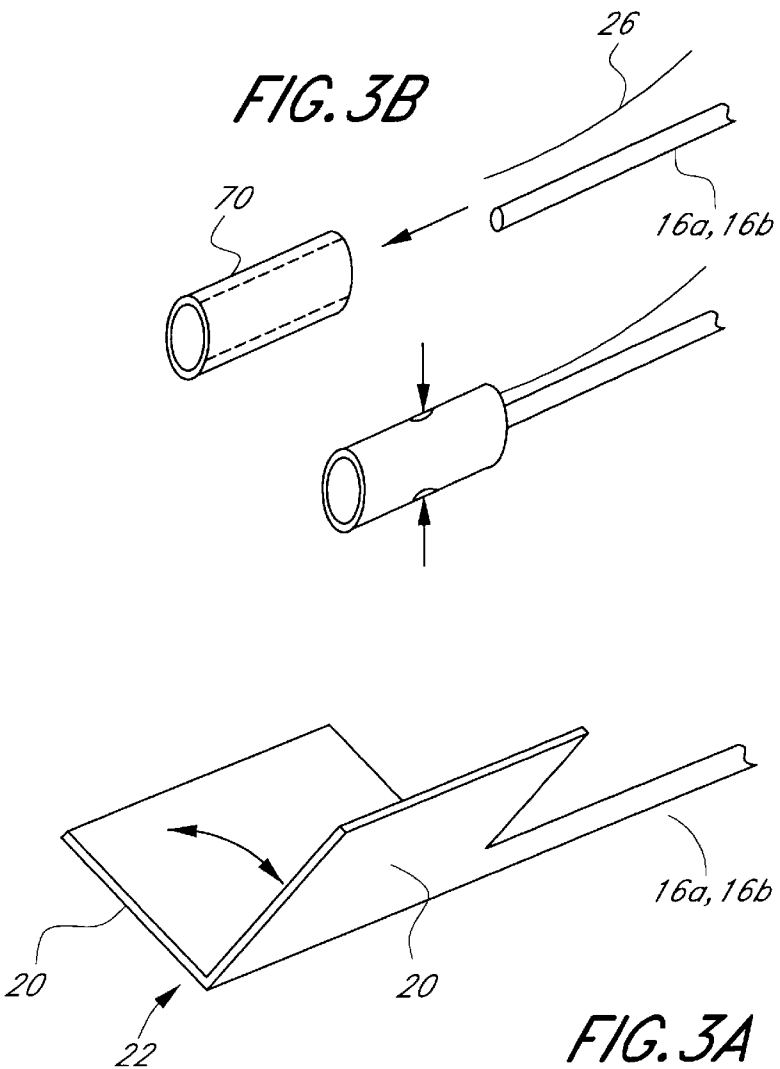
FIG. 3B
FIG. 3A
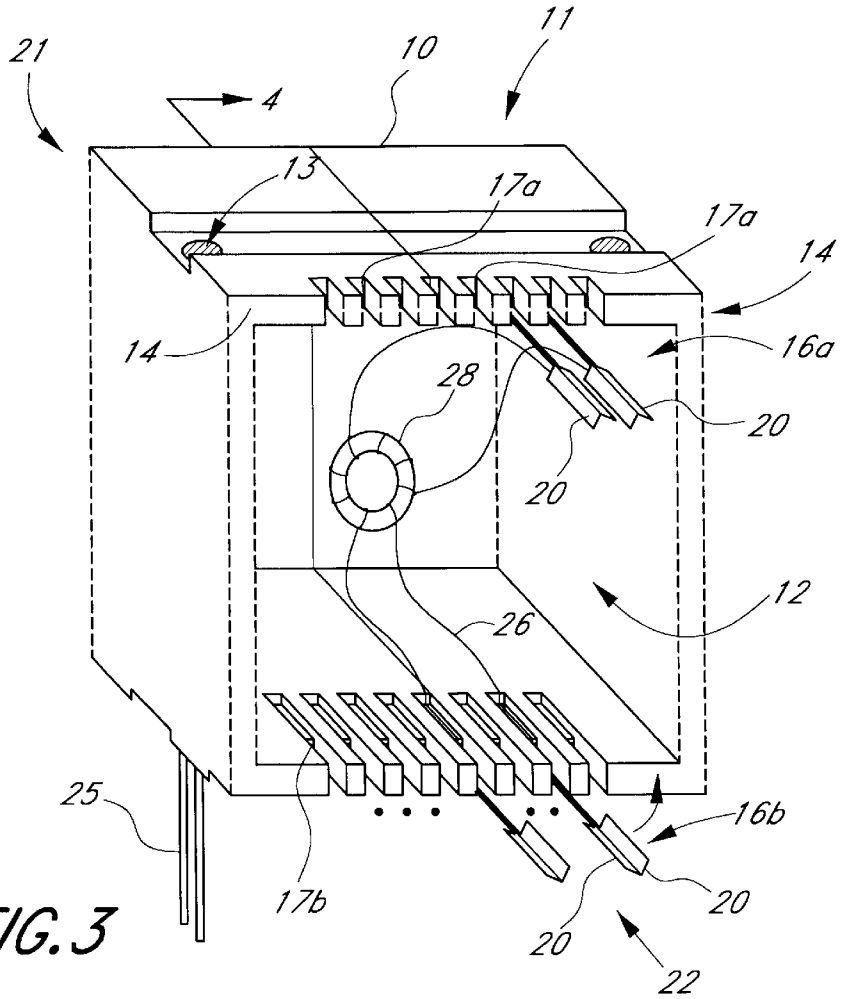
FIG. 3

MODULAR MICROELECTRONIC CONNECTOR AND METHOD FOR MANUFACTURING SAME

RELATED APPLICATIONS

This patent application claims priority under 35 U.S.C. Section 119(e) to U.S. provisional patent application entitled, "Modular Microelectronic Connector and Method", Ser. No. 60/082,467, and filed on Apr. 20, 1998.

BACKGROUND OF THE INVENTION

1. Field of the Invention

The invention relates generally to miniature electrical connectors used in printed circuit board and other microelectronic applications, and particularly to an improved microelectronic connector and method of fabricating the same.

2. Description of Related Technology

Existing microelectronic electrical connectors, such as those of the RJ 45 or RJ 11 type, frequently incorporate magnetics or other electrical components within the connector body itself These components may provide a variety of electrical or signal conditioning functions, such as noise suppression or signal transformation. Often, the magnetics or electrical component is fabricated as part of a package or separate device and then subsequently mounted on a small circuit board; the circuit board assembly is then mounted within a rear connector body element or "trailer." As can be seen in FIG. 1, the trailer 100 is received by the front connector body 102, which also receives the modular plug (not shown). As shown in FIG. 1, a separate lead "carrier" 104 is also commonly used to maintain electrical separation between the leads 106 which mate with the modular plug. The lead carrier 104 is typically molded onto the leads (at a location between the trailer and the distal end of the leads) in a separate process step. See, for example, U.S. Pat. No. 5,587,884 assigned to the Whitaker Corporation, which describes a connector design incorporating both a trailer with circuit board and lead carrier.

However, the fabrication of such prior art connector designs typically requires a significant number of processing steps and labor, thereby increasing cost, and further necessitating the allocation of a significant volume within the connector to the component package, circuit board, and trailer. The additional volume within the connector required by these components may dictate the use of a larger connector body than would otherwise be necessary. This is a substantial detriment, since space conservation is a prime consideration with any electrical component, including connectors. Furthermore, the additional components and process steps associated with fabrication of the component package, trailer, and carrier, and any electrical terminals associated therewith may also ultimately affect both the cost and reliability of the connector as a whole.

Microelectronic connectors may also suffer from internal component failure or damage during use. In this case, the failed connector often must be entirely replaced. However, typical prior art connectors are often not easily removed from their mounting for replacement. Furthermore, when mounted in multiple configurations (such as in side-by-side groupings), the replacement of one. defective connector often necessitates the replacement of all connectors within the configuration. This produces the unnecessary cost of replacing components which have not failed. Modular connector arrangements have been suggested in the prior art; however, such arrangements do not allow variation of the connector grouping configuration (e.g., either vertically or horizontally) using the same connector and mounting hardware.

Accordingly, it would be most desirable to provide an improved low cost and replaceable connector which would 1) reduce the internal connector volume required to house the necessary electrical components; 2) allow for a simpler, more cost effective, and more reliable method of connector fabrication; 3) facilitate replacement without the need for desoldering and/or replacement of other components on the circuit board in the event of connector failure; and 4) permit the user to configure multiple connectors in both an over-under and/or side-by-side arrangement.

SUMMARY OF THE INVENTION

The present invention satisfies the aforementioned needs by providing an improved, simplified microelectronic connector and method of fabricating the same.

In a first aspect of the invention, an improved microelectronic connector is disclosed which utilizes magnetics or other electrical components embedded directly within a cavity in the rear portion of the connector body. The component leads are terminated to exposed leads in the connector body using bendable leadwire crimps which then may be soldered or otherwise bonded if desired. The components and terminated leads are sealed within the cavity using a standard epoxy or other insulating compound, thereby obviating the need for a separate component package and leads and allowing for reduced connector body dimensions.

In a second aspect of the invention, an improved microelectronic connector having a modular construction and the previously described embedded electrical component(s) is disclosed. The aforementioned connector body includes one or more apertures therein which receive respective pins mounted on a connector carrier so as to hold the connector body to the carrier. A transverse land and groove arrangement is also included within the upper and lower mating surfaces of the connector body. The carrier is then fixed to a circuit board or other structure. In this fashion, one or more connector bodies may be attached to the carrier in vertical and/or horizontal arrangement, and any single connector may be removed or replaced as desired.

In a third aspect of the invention, an improved method is disclosed for fabricating a microelectronic connector having embedded internal components. The connector body with cavity is formed using injection molding or other conventional techniques. The electrical components are placed within the cavity and component leads are routed and terminated to the appropriate connector leads using a mechanical crimp. The crimped leads are then bent into place within the cavity, and the cavity is filled with a liquid epoxy or other suitable compound which insulates the component and leads and prevents further movement thereof.

BRIEF DESCRIPTION OF THE DRAWINGS

FIG. 3 is a rear perspective view of the connector of FIG. 2.

FIG. 3*a* is a detail view of the crimp leads of the connector of FIG. 3.

FIG. 3*b* is a detail view of a second embodiment of the crimp leads of the present invention.

DETAILED DESCRIPTION OF THE INVENTION

Reference is now made to the drawings wherein like numerals refer to like parts throughout.

Figure 1:
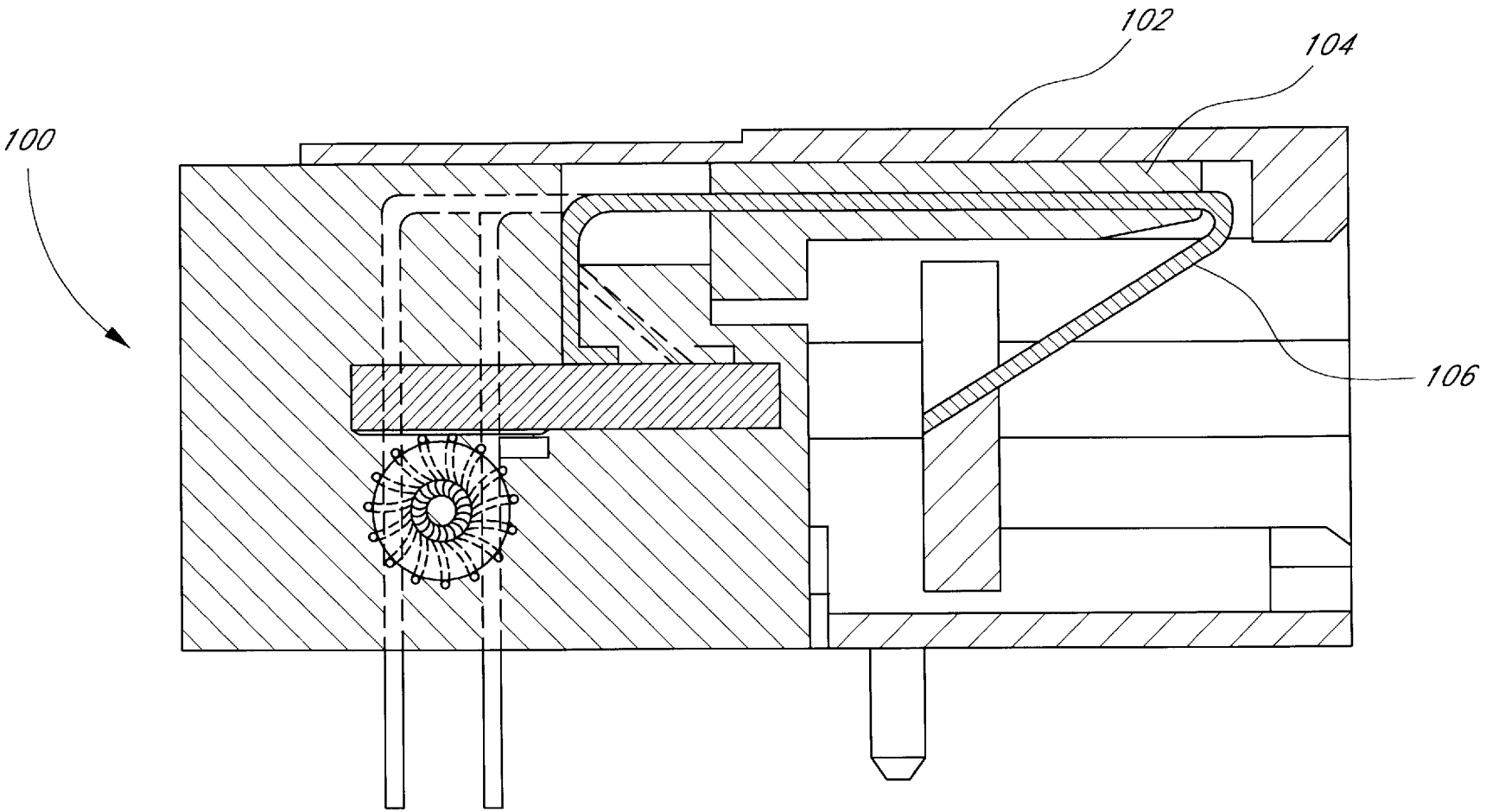
FIG. 1 (Prior Art)
FIG. 1 is cross-sectional view of a prior art electrical component connector utilizing a circuit board and trailer arrangement.
Figure 2:
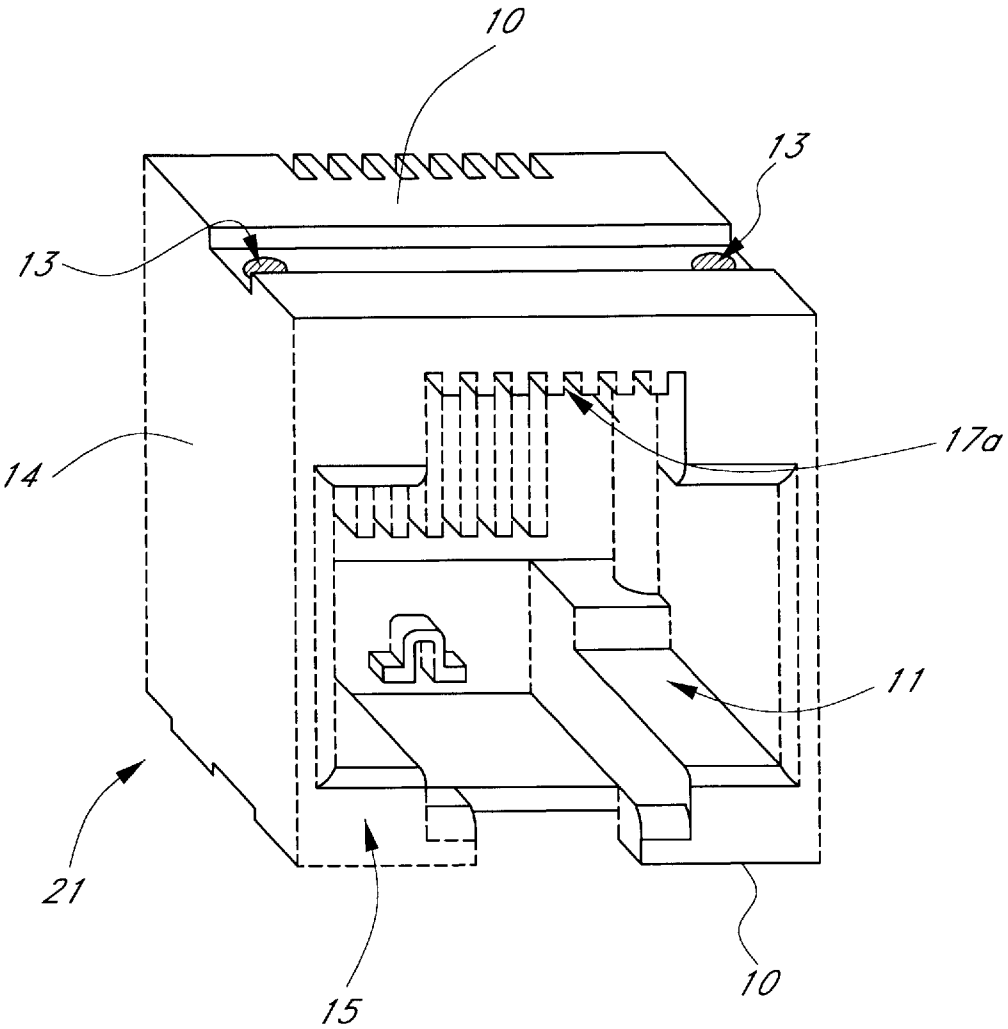
FIG. 2 is a front perspective view of a first embodiment of the connector of the present invention.

FIGS. 2 and 3 show a first embodiment of the microelectronic connector 21 of the present invention (front and rear, respectively). A connector body 10 having a modular plug recess 11, an electrical component cavity 12, two sets of lead passages 17*a*, 17*b*, and a plurality of mounting element apertures 13 disposed therein is formed using any one of a number of conventional methods, ideally injection molding. The outer surfaces of the connector body 10 of the illustrated embodiment are generally rectangular in shape, although other shapes may be used. The body 10 may be comprised of any non-conductive material such as RTP, polyethylene, fluoropolymer, or similar. In this embodiment, the modular plug recess 11 is disposed in the front portion 15 of the connector body 10, while the electrical component cavity 12 is disposed in the rear portion 14, although it can be appreciated that other cavity locations may be used for these purposes (see discussion of FIG. 5 below).

As shown in FIG. 3, first and second sets of crimp leads 16*a*,16*b* are positioned within the body 10 generally adjacent to the cavity 12 and on opposed edges thereof These crimp leads 16*a*,16*b* are fabricated from any electrically conductive and ductile material such as metal or metal alloys. The first set of crimp leads 16*a* act as extensions of the modular plug contact leads 23 (shown in FIG. 4) which provide an electrical path between the electrical contacts on the modular plug (not shown) and the electrical component (s) 28. The second set of crimp leads 16*b* are connected to the external connection leads 25 and provide an electrical pathway between the electrical component(s) 28, the external leads 25, and any external device connected thereto such as a printed circuit board shown in FIG. 4. In this embodiment, each of the first crimp leads 16*a* and their respective modular plug contact leads 23 comprise a unitary, continuous assembly, as do the second crimp leads 16*b* and their respective external connection leads 25. These continuous leads are routed through respective passages 17*a*, 17*b* or alternatively grooves (not shown) formed in the connector body 10 leading to the rear cavity 12. In this manner, a series of continuous leads can simply be inserted or molded into the passages 17*a*,17*b* or into grooves of the connector body during connector fabrication and can subsequently be bent or deformed to the desired shape. It can be appreciated, however, that any number of different arrangements for connecting and routing the crimp leads 16*a*, 16*b* to the contact leads 23 and external leads 25 may be used.

As illustrated in FIG. 3, the electrical component 28, in this case a magnetic choke coil, is disposed within the cavity 12 and the conductors 26 thereof are routed to the connector crimp leads 16*a*, 16*b*. It will be understood that with respect to the present invention, the term "electrical component" includes but is not limited to resistors, capacitors, inductors, choke coils, transformers, and semiconductive devices. As shown in FIG. 3*a*, these crimp leads may have two (or more) flutes 20 located at their distal ends 22 which form a "V" shaped structure into which the component conductors 26 are received. The flutes 20 are ductile such that when a closing or crimping force is applied to the outer surfaces of the flutes, both flutes 20 deform and crimp the conductor 26 enclosed there between, holding the conductor in place.

FIG. 3*b* shows a second embodiment of the crimp lead arrangement of the present invention. In this second embodiment, a separate crimp element 70 is placed over the distal end 22 of the crimp leads and conductors 26 and is subsequently crimped to from a mechanical bond. The crimp elements 70 are generally cylindrical in shape and hollow, and are fabricated from a ductile material such that they are easily deformed under crimping force, yet maintain a strong mechanical bond. The distal ends 22 of the crimp leads 16*a*, 16*b* in this embodiment are also generally cylindrical in shape yet not hollow, and do not include the flutes 20 as in the prior embodiment described above. It will also be recognized that other shapes and configurations may be used for the crimp elements 70, such as partial cylinders (semicircular cross-section) or staples.

In addition to or as an alternative to crimp bonding, the conductors 26 of the electrical component may be soldered or otherwise bonded to the crimp leads 16*a*, 16*b*. For example, the crimped conductor may be subsequently fluxed and soldered using any number of soldering techniques well known in the electrical arts. Alternatively, a crimp lead having a "U" shaped distal end may be used, wherein the conductors 26 are laid within the "U" and subsequently fluxed and soldered without crimping. As yet another alternative, the conductors can be heated with laser energy or other means to effectively weld or fuse the conductors to the crimp leads 16*a*, 16*b*.

After the conductors 26 are crimped and/or bonded to their respective crimp leads 16*a*, 16*b*, the crimp leads and conductors are bent or folded downward so as to extend into the cavity 12. Ideally, the bend is 90 degrees or greater so that the ends of the crimp leads 16*a*, 16*b* are below the plane of the rear face of the connector body. Prior to bending, the relative extension of the crimp leads 16*a*, 16*b* beyond the edges of the cavity 12 allows the comparatively ductile leads to be easily folded into the cavity after the component conductors 26 are bonded thereto. Specifically, the edges 37 of the connector body 10 to which the crimp leads are adjacent act as fulcrums to permit the adjacent region 39 of the leads to bend. Alternatively, the crimp leads 16*a*, 16*b* may be tapered or thinned in the adjacent region 39 near the connector body 10 such that they preferentially bend in this region.

The electrical component 28, crimp leads 16*a*, 16*b*, and conductors 26 are ultimately encapsulated within the cavity 12 using an epoxy 30, although other such insulating compounds may used based on the properties desired. The epoxy is ideally pour-filled into the cavity 12 so as to immerse the electrical component(s) and crimp leads entirely and fill the cavity 12. The epoxy is then allowed to dry to form a hard, permanent structure.

Note that by using the above-described construction, the space necessary to accommodate the component(s) 28 is reduced as compared to the prior art, since no other leads, parts or packages are required. Hence, the overall size of the connector may be smaller or, alternatively, more components can be fit within a given connector size. It is further anticipated that individual smaller cavities or recesses may be used in place of the single large cavity 12 described above, thereby providing electrical separation between individual electrical components 28 and minimizing the amount of epoxy necessary to fill the connector body 10.

Note also that the above-described construction substantially reduces the number of process steps necessary to fabricate the finished connector; specifically, those steps associated with fabricating a separate component package and the connector body leads associated therewith, or a trailer, are obviated in the present invention.

Figure 4:
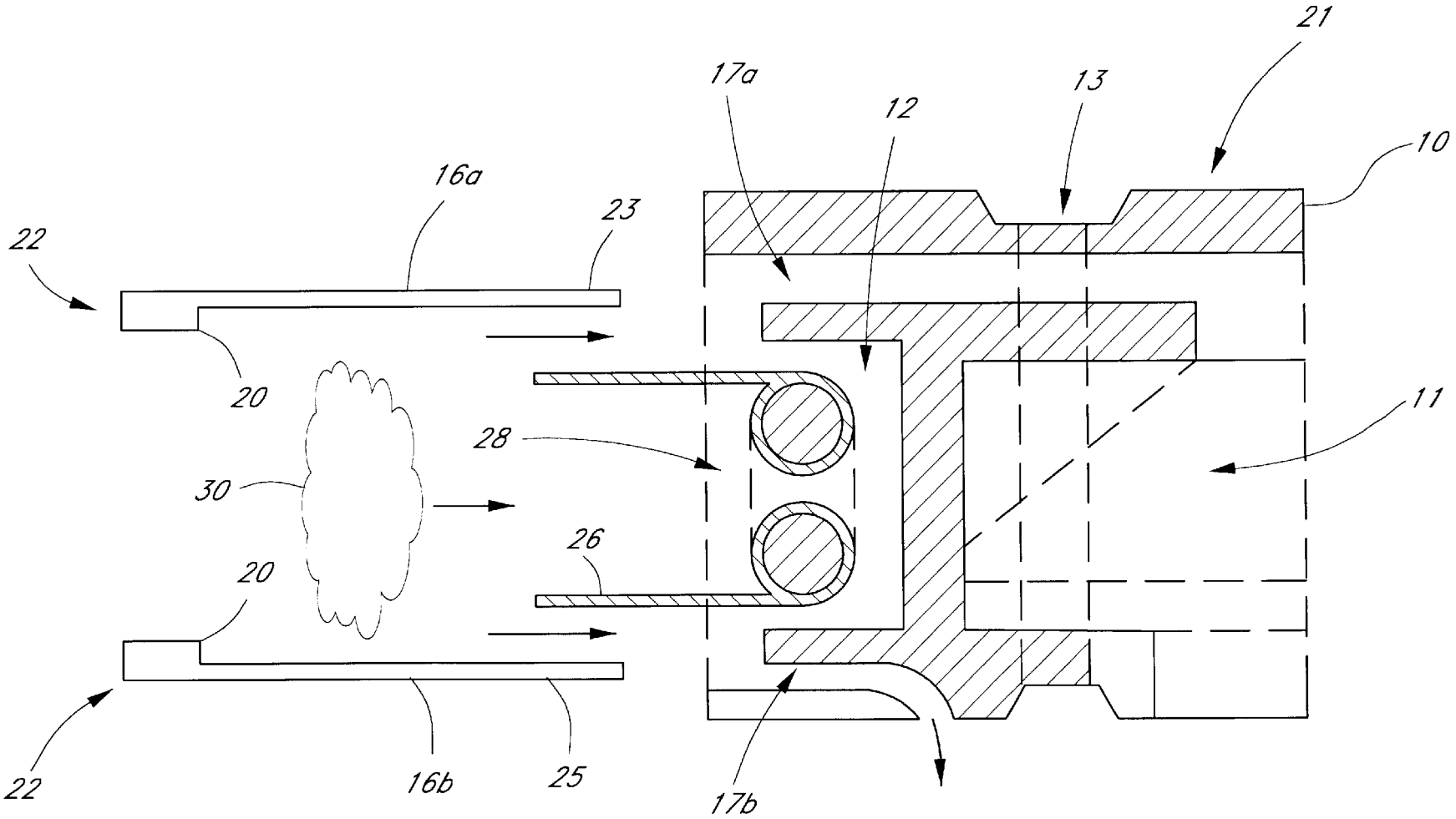
FIG. 4 is a cross-sectional view taken along line 4—4 of FIG. 3 illustrating the internal arrangement of components within the connector.

FIG. 4 shows a cross-sectional view of the connector of FIGS. 2 and 3 mounted on a printed circuit board, illustrating the relationship and placement of the internal components of the connector and the external modular plug 31. The use of continuous modular plug contact leads 23 and external connection leads 25 which terminate in the first and second crimp leads 16*a*, 16*b*, respectively, is clearly shown.

Figure 5:
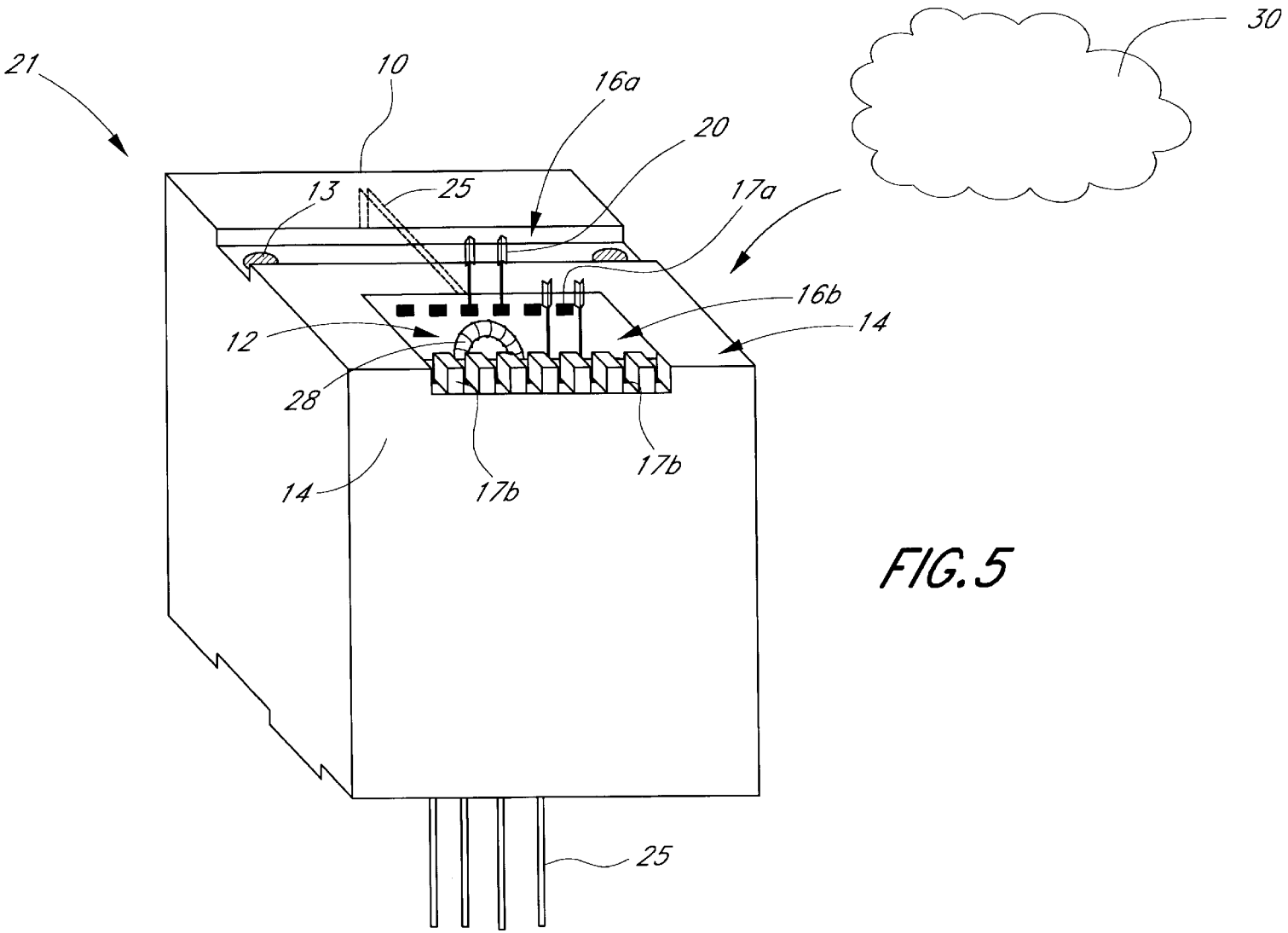
FIG. 5 is a perspective view of a second embodiment of the connector of the present invention, having the electrical component and cavity located in the top portion of the connector body.

FIG. 5 shows a second embodiment of the microelectronic connector of the present invention. In this embodiment, the cavity 12 is located adjacent to and communicating with the top surface 34 of the connector body 10, and grooves 32 are formed within the top surface 34 and rear surface 36 of the body 10 to allow for the passage of component leads 25 to the connector crimp leads 16*b*.

Figure 6:
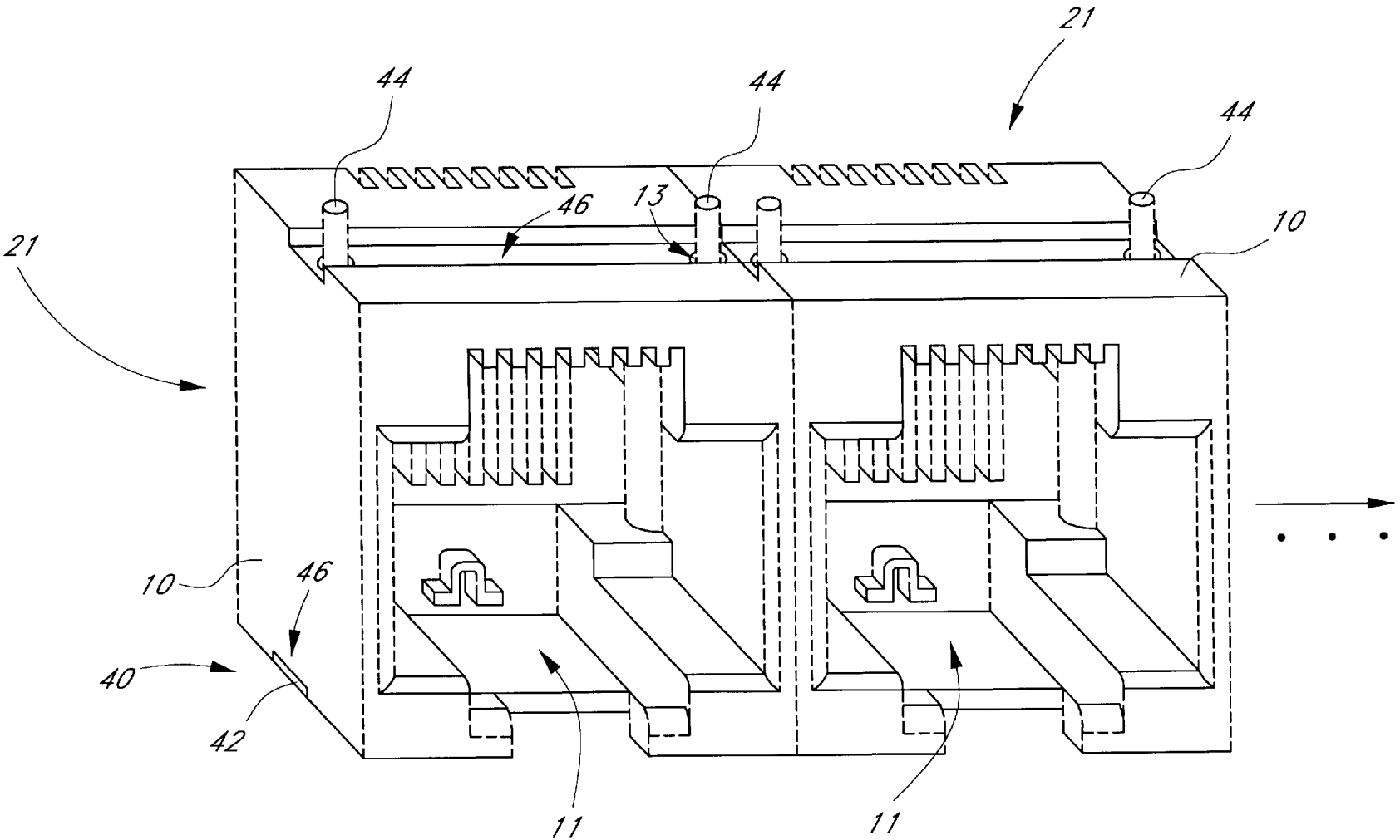
FIG. 6 is a perspective view of a multiple modular connector assembly mounted on a first embodiment of the connector carrier of the present invention.
Figure 7A:
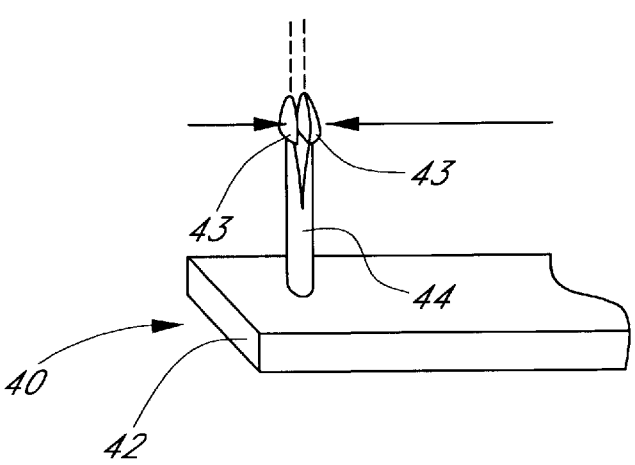
FIG. 7*a* is a detail view of a second embodiment of the connector carrier of the present invention.

Referring now to FIG. 6, two connectors 21 of the type illustrated in FIGS. 2 through 4 are shown mated to a first embodiment of a connector carrier 40. The carrier 40 (shown in detail in FIG. 7), is comprised of a base element 42 having one or more mounting elements 44 substantially normal thereto. The carrier 40 is ideally formed from an injection molded polymer, although other materials may be used. In the present embodiment, the mounting elements 44 are cylindrically shaped pins, although other arrangements may be employed. The pins 44 of the carrier 42 are spaced so as to fit within the corresponding apertures 13 of each connector body 10, while the base element 42 fits substantially within a lateral recess 46 of each body 10. The mating pins may be of any cross-sectional shape as desired such as square to prevent connector body rotation when using a single pin. In a second embodiment, the mating elements may also be of split design with retaining clips 43 as illustrated in FIG. 7*a* to prevent unwanted separation of the connector 21 from the carrier 40.

Figure 8:
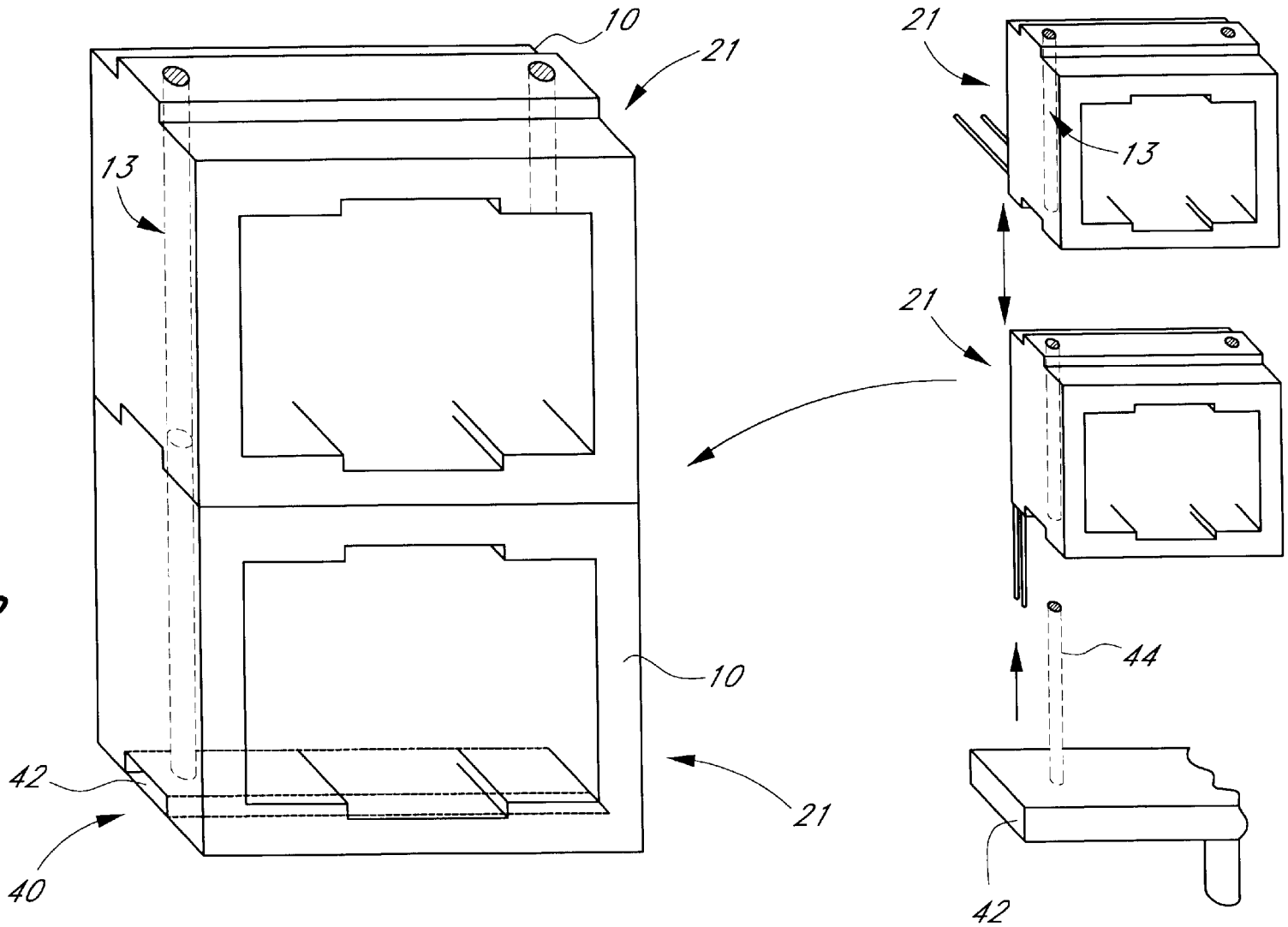
FIG. 8 is a perspective assembly drawing of a third embodiment of the connector carrier of the present invention, showing two connectors mounted vertically thereon.

Alternatively, a third embodiment of the carrier having longer mating pins 44 may be used to permit vertical stacking of the connector bodies 10 as shown in FIG. 8. The elongated pins 44 protrude through the apertures 13 to a height sufficient to allow mating of the pins 44 with apertures 15 in successive connector bodies. In this embodiment, the pins 44 are made severable at discrete locations corresponding to the installed height of n connectors, where n is an integer greater than or equal to 1. Note that while no theoretical maximum number of connectors which may be vertically stacked exists, most microelectronic applications would use no more than two or three vertical rows of connectors. The pins may be made severable using any number of techniques well known in the mechanical arts, including circumferential scoring in the desired region(s) (shown in FIG. 8), or a localized reduction in pin thickness. Alternatively, the pins 44 can be made in snap-together longitudinal segments.

Note also that the connector body of FIG. 8 employs a top land 50 which mates with the transverse recess 46 of the connector body stacked above it, thereby providing additional mechanical stability and strength, Such an arrangement may also be used on the side surfaces of the connectors illustrated in FIG. 6 if desired to provide further stability.

Figure 7:
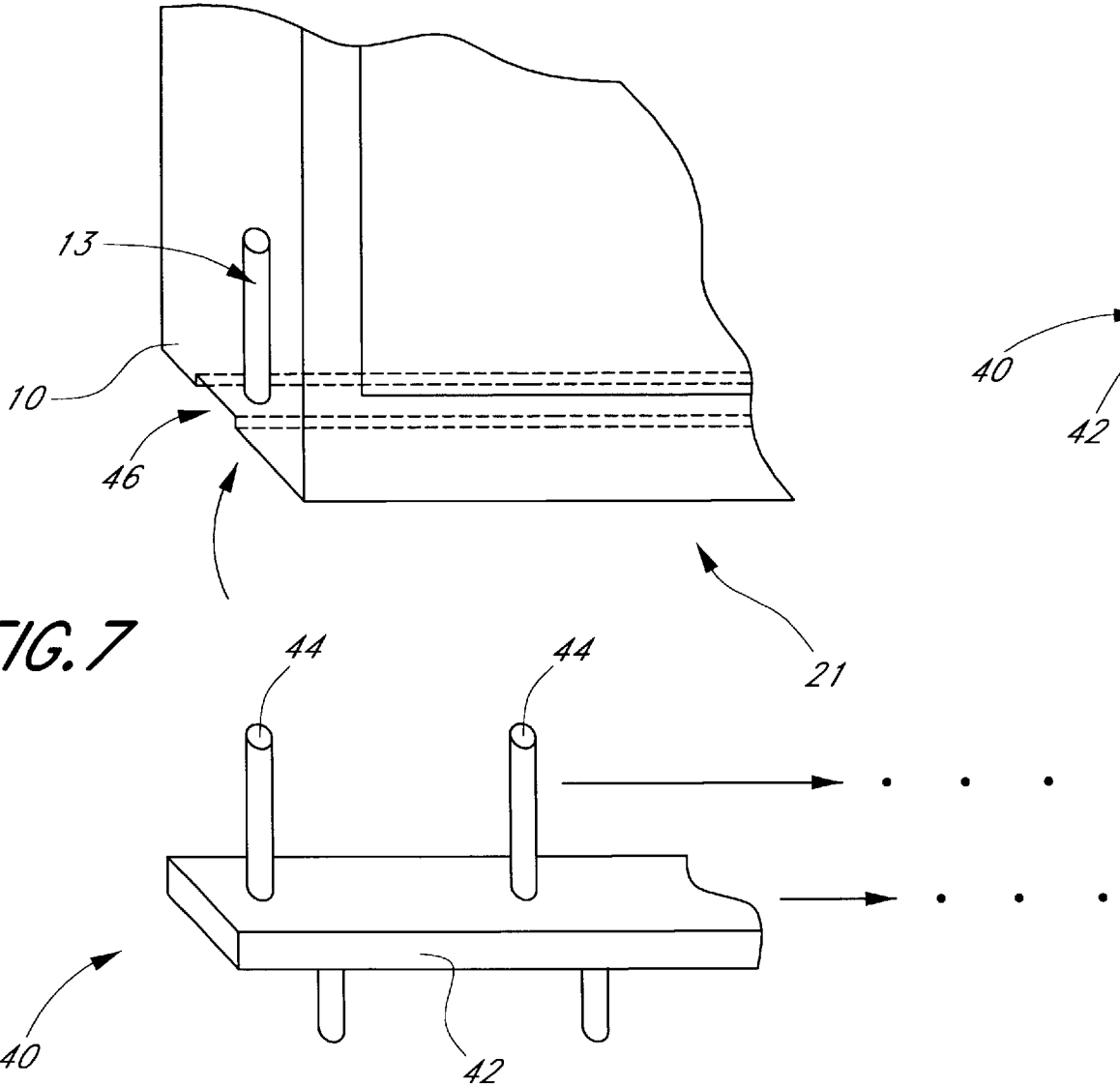
FIG. 7 is a detail perspective view of the connector carrier of FIG. 6.

The carrier(s) of FIGS. 7 through 8 are attached to an external device (such as a printed circuit board, not shown) using any number of attachment means including, without limitation, snap pins and holes, or adhesives. Alternatively, the carrier may be formed directly within or as part of the external device. The selected method of attachment must have sufficient rigidity so as to allow the addition and/or removal of individual connector bodies to the connector carrier 40 without separating the carrier 40 from the external device.

It should further be noted that various connector configurations may be used in conjunction with the pin/aperture arrangement described above. See, for example, Applicant's co-pending patent application entitled "Two-Piece Microelectronic Connector and Method,", Ser. No. 09/169,842, filed Oct. 9, 1998, incorporated herein by reference in its entirety, which describes one microelectronic connector configuration compatible with the present invention.

Method of Manufacturing

Figure 9:
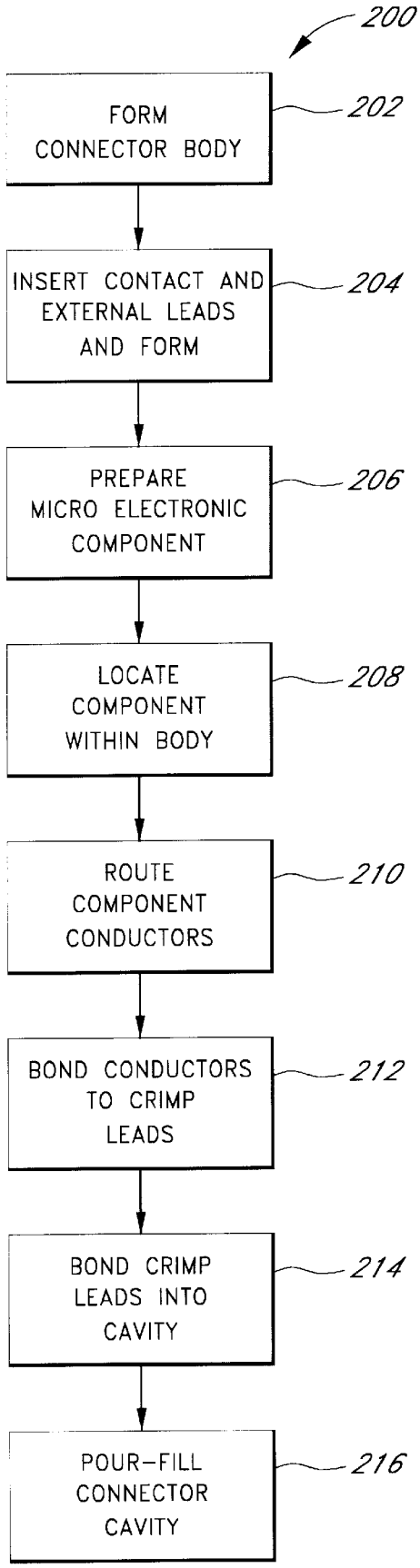
FIG. 9 is a process flow diagram illustrating one embodiment of a method of manufacturing the microelectronic connector of the present invention.

Referring now to FIG. 9, one embodiment of a method of manufacturing the improved microelectronic connector of the present invention is disclosed.

FIG. 9 is a process flow diagram generally illustrating the method or process of manufacturing. As shown in FIG. 9, the process 200 of the present invention begins with a first process step 202 of forming a connector body 10 having a modular plug recess 11, cavity 12, and passages 17*a*, 17*b* as previously described. The connector body is formed using injection molding techniques well known in the polymer arts, although it will be recognized that other molding or formation techniques may be employed. Injection molding is chosen in part, however, for its ease of use and substantial economies.

In the second process step 204, the modular plug contact leads 23 and external connection leads 25 are prepared and inserted into their respective passages 17*a*, 17*b* in the connector body. In the embodiment of FIGS. 2–4, the plug contact leads are inserted into their passages 17*a* from the rear of the connector and subsequently bent within the modular plug recess to the desired shape, thereby retaining the leads 23 in position relative to the connector body. The external connection leads 25 are similarly inserted into their respective passages 17*b* and formed to the desired shape (projecting in a direction normal to the bottom surface of the connector body in the embodiment of FIGS. 2–4). Note that the external connection leads may alternatively be formed into their final shape prior to formation of the connector body, and then positioned within the injection mold and effectively molded into place.

Next, an electrical component 28 (such as the choke coil shown in FIG. 10*a*, discussed below) is prepared in a third process step 206. This component preparation may include, for example, the formation of a toroidal core and subsequent winding of the core with electrical conductors 26.

In a fourth process step 208, the electrical component 28 fabricated in the third process step 206 is placed within the cavity 12. In the fifth process step 210, the conductors 26 of the component 28 are routed (either manually or by machine) to the appropriate crimp leads 16*a*,16*b* of the connector. A crimping machine (not shown) or other device is then used in the sixth process step 212 to 1) crimp the flutes 20 of the crimp leads 16*a*, 16*b* around the component conductors 26 so as to form a friction fit; and 2) sever the portions 54 of the component conductors 26 which extend beyond the end of the crimp leads 16*a*, 16*b*. If desired, the crimped leads 16*a*, 16*b* may be solder-dipped or otherwise bonded for additional strength and reliability, or optionally, solder or other bonding may be used as the exclusive method of attachment.

As shown in FIG. 9, the seventh process step 214 includes bending the crimp leads 16*a*, 16*b* into place substantially into the cavity 12. As previously noted, the edges of the connector body passages 17*a*, 17*b* or grooves act as fulcrums to permit the leads to be bent in the region 39 immediately adjacent to the connector body so that the profile of the connector as a whole is minimized.

Finally, in the eighth process step 216, the cavity 12 is pour-filled with epoxy 30 or other compound to seal the electrical component(s) in place. Note that while pour-filling is described, other methods of epoxy/compound placement and curing (or insert molding) may be used with equal success.

It will be recognized that while the aforementioned process steps are performed in a sequential fashion, the order of performance of certain of these steps may be permuted, or certain steps performed in parallel with other steps. For example, the formation of the connector body 10 and the electrical component 28 can be accomplished in parallel in order to increase production throughput. Also, it may be desirable to bond the conductors 26 of the component 28 to the crimp leads 16*a*, 16*b* prior to inserting the component into the cavity 12 of the connector body 10. A substantial number of such variations are possible, and considered to be within the scope of the present invention.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention.

What is claimed is:

1. A microelectronic connector, comprising:

a connector body having a first cavity and second cavity, said first cavity adapted to receive at least part of a plug having a plurality of electrical contacts;

a plurality of first crimp leads, each having a first and second end, said first end of said first crimp leads being positioned at least partly within said second cavity, said second end of said first crimp leads being disposed at least partly within said first cavity;

a plurality of second crimp leads, each having a first and second end, said first end of said second crimp leads being positioned at least partly within said second cavity, said second end of said second crimp leads adapted for electrical connection to an external device; and an electrical component disposed at least partly within said second cavity, said electrical component having at least one electrical conductor, said at least one conductor being electrically connected to at least one of said first crimp leads and at least one of said second crimp leads such that an electrical signal may be transferred from said electrical contacts of said plug to said external device through said electrical component.

2. The microelectronic connector of claim 1, wherein said electrical component is a choke coil.

3. The microelectronic connector of claim 1, wherein said first and second crimp leads are comprised of a ductile material.

4. The microelectronic connector of claim 3, wherein said first and second crimp leads further include at least one crimp element proximate to said first end to permit crimping of said conductors to respective ones of said crimp leads.

5. The microelectronic connector of claim 1, wherein said at least one crimp element comprises a plurality of flutes, at least two of which may be forced into physical contact with each other in order to crimp at least one of said conductors.

6. The microelectronic connector of claim 1, wherein said microelectronic connector is an RJ 45 type connector, and said plug is a modular plug.

7. The microelectronic connector of claim 1, wherein said electrical component and at least a portion of said first and second crimp leads are encapsulated within said cavity using a sealant.

8. The microelectronic connector of claim 7, wherein said sealant is an epoxy.

9. The microelectronic connector of claim 3, wherein said connector body is comprised of a polymer and formed using injection molding techniques.

10. The microelectronic connector of claim 3, wherein said external device is a printed circuit board.

11. The microelectronic connector of claim 1, wherein said connector body further includes at least one aperture adapted to receive a mounting element attached to an external device, said aperture and mounting element cooperating to retain said connector body in a substantially fixed relationship with respect to said external device.

12. The microelectronic connector of claim 4, wherein said connector body further includes at least one aperture adapted to receive a mounting element attached to an external device, said aperture and mounting element cooperating to retain said connector body in a substantially fixed relationship with respect to said external device.

13. The microelectronic connector of claim 12, wherein said mounting element is a pin.

14. A microelectronic connector, comprising:

a connector body having a first cavity and second cavity, said first cavity adapted to receive at least part of a modular plug having a plurality of electrical contacts;

an electrical component disposed in said second cavity, said component having at least one electrical conductor;

a plurality of first crimp leads, at least one of which is electrically connected to said at least one conductor of said electrical component, said plurality of first crimp leads being positioned at least partly within said second cavity;

a plurality of first electrical leads disposed at least in part within said first cavity, said first leads being connected so as to form an electrical connection between at least one of said electrical contacts of said modular plug and at least one of said first crimp leads;

a plurality of second crimp leads, at least one of which is electrically connected to said at least one conductor of said electrical component, said plurality of second crimp leads being positioned at least partly within said second cavity; and a plurality of second electrical leads, at least one of which is electrically connected to said at least one second crimp lead so as to connect said microelectronic connector to an external device.

15. A modular microelectronic connector assembly, comprising:

a connector body having a first and second cavity, said first cavity being adapted to receive at least part of a modular plug;

an electrical component disposed in said second cavity, said component having a plurality of conductors;

a plurality of electrical contacts disposed at least partly within said first cavity and connected to said electrical component via at least one of said conductors;

a connector carrier having a plurality of mounting elements mounted thereon; and at least one aperture in said connector body for receiving at least one of said mounting elements, wherein a plurality of said connector bodies may be mounted to said carrier simultaneously.

16. The modular microelectronic connector assembly of claim 15, wherein said mounting elements are pins.

17. The modular microelectronic connector assembly of claim 15, wherein said electrical contacts are connected to said conductors of said electrical component using a plurality of crimp leads which are crimped about said conductors.

18. The modular microelectronic connector assembly of claim 17, wherein said crimp leads are comprised of a ductile material, and are crimped about said conductors of said electrical component.

19. A circuit board assembly having a plurality of microelectronic connectors mounted thereon, comprising:

a circuit board having a plurality of electrical contacts;

a connector carrier attached to said circuit board, said carrier including a plurality of mounting elements;

a plurality of microelectronic connectors, each of said connectors including;

a connector body having at least one cavity formed therein, said at least one cavity being adapted to receive a modular plug having a plurality of contacts;

at least one electrical component having at least one conductor disposed within said at least one cavity;

a plurality of first electrical leads connecting said at least one conductor of said electrical component to at least one of said contacts of said modular plug;

a plurality of second electrical leads connecting said at least one conductor of said electrical component to said board; and at least one aperture adapted to receive respective ones of said mounting elements of said carrier;

wherein said connectors are mounted on said carrier such that at least one of said second electrical leads of each connector forms an electrical connection with a respective one of said contacts of said circuit board.

20. The circuit board assembly of claim 19, wherein at least one of said first and second leads comprise crimp leads.

21. A method of manufacturing a microelectronic connector, comprising:

providing a connector body having a cavity;

providing an electrical component having a plurality of electrical conductors;

providing a plurality of crimp leads;

disposing said crimp leads at least partly within said connector body such that said crimp leads are proximate to said cavity;

disposing said electrical component within said cavity;

forming an electrical connection between said crimp leads and said conductors of said electrical component; and deforming said crimp leads such that they are at least partially disposed within said cavity.

22. The method of claim 21, wherein said method further includes the act of applying a sealant to said electrical component so as to maintain said component and said connector body in a fixed relationship.

23. The method of claim 22, wherein the act of forming an electrical connection between said crimp leads and said conductors further includes the act of crimping the crimp leads to the conductors.

24. A method of manufacturing a circuit board having a plurality of microelectronic connectors, comprising:

providing a plurality of connector bodies each having a cavity;

providing a plurality of electrical components each having a plurality of electrical conductors;

providing a plurality of crimp leads;

disposing said crimp leads at least partly within respective ones of said connector bodies such that said crimp leads are proximate to said cavity of said respective connector bodies;

disposing said electrical components within respective ones of said cavities;

forming an electrical connection between said crimp leads and said conductors of said electrical components;

deforming said crimp leads such that they are at least partially disposed within said cavity of each respective connector;

applying a sealant so as to maintain said electrical components and their respective connector bodies in a fixed relationship;

providing a circuit board having a plurality of electrical contacts;

providing a connector carrier having a plurality of mounting elements thereon;

affixing said carrier to said circuit board; and mounting said connector bodies to said carrier.

25. An electric connector, comprising:

a connector body having a first and a second cavity, said connector body being of unitary construction, said first cavity being adapted to receive at least part of a modular plug having electrical contacts;

an electrical component disposed in said second cavity, said component having a plurality of conductors;

a plurality of first electrical leads disposed within said first cavity, said first electrical leads being connected to said electrical component and said electrical contacts of said modular plug; and a plurality of second electrical leads connected to said electrical component, said second leads adapted to connect said electrical connector to an external device;

wherein said electrical component and at least a portion of said first and second electrical leads are encapsulated within said cavity using a sealant.

26. A microelectronic connector, comprising:

a connector body having a first and a second cavity, said connector body being of unitary construction, said first cavity being adapted to receive at least part of a modular plug having electrical contacts;

means for conditioning an electrical signal, said means for conditioning being disposed in said second cavity;

first means for conducting an electrical signal, said first means disposed at least partly within said first cavity and electrically connected to said means for conditioning and connectable to said electrical contacts of said modular plug;

second means for conducting an electrical signal, said second means being electrically connected to said means for conditioning, said second means adapted to connect said microelectronic connector to an external device; and means for maintaining said means for conditioning and said first means for conducting in a fixed position relative to said connector body, said means for maintaining at least partly filling said second cavity.

27. The microelectronic connector of claim 26, wherein said means for conditioning an electrical signal comprises an electrical component having a plurality of conductors.

28. The microelectronic connector of claim 27, wherein said electrical component comprises a toroidal choke coil.

29. The microelectronic connector of claim 26, wherein said first means for conducting an electrical signal comprises a plurality of crimp leads.

30. The microelectronic connector of claim 26, wherein said means for maintaining said means for conditioning and said first means for conducting in relative position to said connector body comprises an epoxy fill.

31. A modular microelectronic connector assembly having independently removable connectors, comprising:

a plurality of microelectronic connectors, each of said connectors having;

a connector body having a first and second cavity, said first cavity being adapted to receive at least part of a modular plug having contacts disposed therein;

an electrical component disposed in said second cavity, said component having a plurality of conductors;

a plurality of electrical contacts disposed within said first cavity and connected to said electrical component via at least one of said conductors, said electrical contacts being capable of mating with said contacts of said modular plug when said modular plug is received within said first cavity;

a connector carrier having a plurality of mounting elements mounted thereon; and at least one aperture in each of said connector bodies for receiving at least one of said mounting elements, wherein said microelectronic connectors are mounted on said carrier in a predetermined configuration, and are independently removable from said carrier.

32. The connector assembly of claim 31, wherein said electrical contacts disposed within said first cavity include at least one crimp lead.

* * * * *